United States Patent [19]

Zelenka

[11] Patent Number: 4,640,553

[45] Date of Patent: Feb. 3, 1987

[54] BRAKE SYSTEM FOR CUTTERS OF SURFACE CLEANING CUTTER CAGE

[75] Inventor: Frank Zelenka, Rexdale, Canada

[73] Assignee: Bartell Industries Ltd., Weston, Canada

[21] Appl. No.: 697,014

[22] Filed: Jan. 31, 1985

[51] Int. Cl.[4] ..... E01C 23/08; E01C 23/12

[52] U.S. Cl. ..... 299/39; 299/40; 404/90

[58] Field of Search ..... 299/39, 40, 85; 51/176; 125/3, 5; 404/90, 91

[56] References Cited

U.S. PATENT DOCUMENTS

| | | | |
|---|---|---|---|
| 1,964,746 | 7/1934 | Sloan | 299/39 |
| 3,063,690 | 11/1962 | Cornell | 299/39 |
| 3,156,231 | 11/1964 | Harding, Jr. | 299/39 |
| 3,266,846 | 8/1966 | Luksch et al. | 299/39 |

FOREIGN PATENT DOCUMENTS

| | | | |
|---|---|---|---|
| 2417752 | 7/1975 | Fed. Rep. of Germany | 404/90 |

*Primary Examiner*—Stephen J. Novosad
*Assistant Examiner*—Michael A. Goodwin
*Attorney, Agent, or Firm*—Sim & McBurney

[57] ABSTRACT

Apparatus is disclosed for removing material from the surface of a solid substrate. A rotary cutter cage is mounted on a support frame and has at least one row of a plurality of cutters mounted on a bar connected to the cutter cage. The cutters impact a solid substrate during rotation of the cutter cage. Each cutter has a bore through which the bar extends in mounting the plurality of cutters on the cutter cage. The bore is larger than the bar to permit rotation of each cutter on the bar at least during contact with the surface being treated. A brake is provided on the cutter cage to brake rotation of the cutters after each occurrence of a corresponding row of cutters contacting the surface being treated during rotation of the cutter cage.

18 Claims, 7 Drawing Figures

FIG. 5.
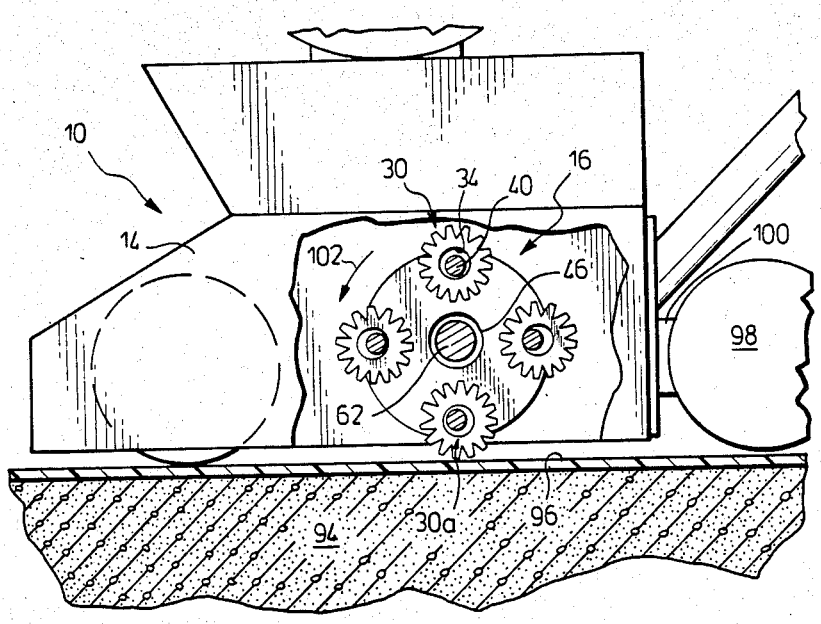
FIG. 6.
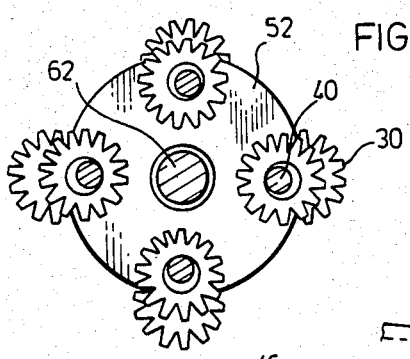
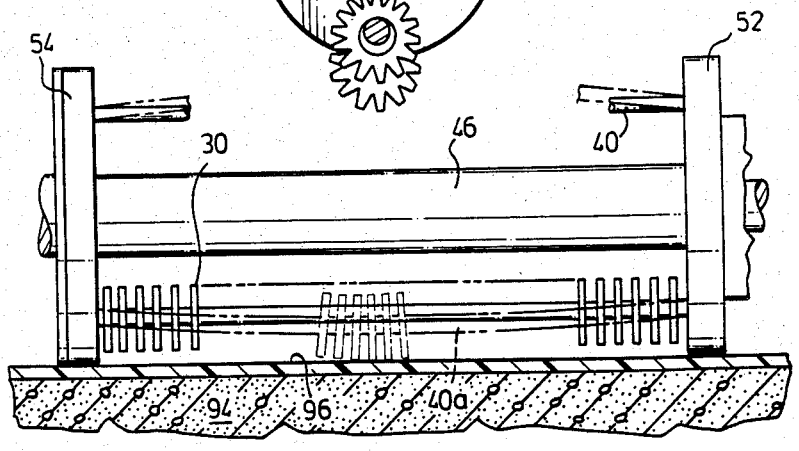
FIG. 7.

BRAKE SYSTEM FOR CUTTERS OF SURFACE CLEANING CUTTER CAGE

FIELD OF THE INVENTION

This invention relates to surface treatment equipment for removing a layer of the surface and in particular rotary cutter cages having a plurality of cutters for impacting the surface being treated.

BACKGROUND OF THE INVENTION

It is often desirable to remove a layer from a solid substrate, such as concrete pavement, metal decks, fiberglass decks and the like, to prepare the surface for a subsequent finish coating such as painting, sealing or retopping. A hand operated concrete surface treatment apparatus is disclosed in U.S. Pat. No. 3,156,231. A rotary cutter cage for the apparatus carries a plurality of star-shaped cutter elements. During rotation of the cutter cage, the cutter elements impact the concrete surface to chip away a layer from the surface. A larger self-propelled surface conditioning machine is disclosed in U.S. Pat. No. 3,266,846. The apparatus includes a rotary cutter cage having several cutter elements. The cutter cage is rotated and transported across the surface to be treated to remove a layer of material from the surface. Other examples of concrete milling machines or planars using star-shaped cutter elements are disclosed in U.S. Pat. Nos. 3,063,690 and 3,156,231. In U.S. Pat. No. 3,156,231, the series of circular star cutter wheels, as mounted on a bar of the cutter cage, are held in place by the use of crimped washers or the like beyond the extreme ends of the pack. Such crimped washers serve to center and locate the series of cutter elements on each bar of the cutter cage.

U.S. Pat. No. 2,795,176 discloses a pulverizing machine for use in treating hard substrates, such as concrete. The system pulverizes the surface by rapidly rotating tools or hammers which impact the surface over which they travel. Springs are used at the base of each hammer, as pivotally connected to a drive shaft, to yieldably position the hammer in a radially outwardly extending position. This enables each arm to yield in case of impact against an underlying hard object, as well as to yield in response to inertia during the starting and stopping of the shaft, thus permitting smoother operation of the machine.

In the operation of surface treatment systems, such as disclosed in U.S. Pat. No. 3,063,690, the star-shaped cutters rotate at high speeds relative to the bars on which they are mounted. This is due to the contacting of the star-shaped cutters with the solid substrate causing the cutters to rotate at high speeds relative to the bars in a direction opposite to the direction of rotation of the cutter cage. The apparatus, according to this invention, prevents continued rotation of the cutters on the cutter cage to significantly improve the efficiency and effectiveness of the cutter elements in removing material from the solid substrate being treated.

SUMMARY OF THE INVENTION

According to an aspect of the invention, a support frame is provided for an apparatus for removing material from the surface of a solid substrate. A rotary cutter cage is mounted on the support frame. Means is provided for rotating the rotary cutter cage. The rotary cutter cage has at least one row of a plurality of cutters mounted on a bar connected to the rotary cutter cage.

The cutters impact the solid substrate during rotation of the cutter cage. Each of the cutters has a bore through which the bar extends in mounting the plurality of cutters on the cutter cage. The bore is larger than the bar to permit rotation of each cutter on the bar at least during contact with the surface being treated. The cutter cage has means for braking rotation of the cutters after each occurrence of a corresponding row of the cutters contacting the surface being treated during rotation of the cutter cage.

The brake means is provided for each of the at least one bar for frictionally engaging adjacent cutters and frictionally engaging end portions of the row of cutters with the respective plate portions. The brake means establishes a degree of frictional engagement between the cutters and the plate portions to permit the cutters to rotate during contact with the surface being treated and brake rotation of the cutters before the row of cutters contact such surface again. The brake means comprises a compressible resilient material associated with each row of cutters. The extent to which the material is compressed determines the degree of frictional engagement.

According to another aspect of the invention, a rotary cutter cage for use with the apparatus comprises an axle with at least two opposing plate portions mounted on the axle. The plate portions have means for carrying at least one bar extending between the plate portion. The at least one bar is radially spaced from and parallel to the axle. The bar has a row of a plurality of cutters mounted thereon by each of the cutters having a bore through which the bar extends. The bore is larger than the bar to permit relative rotation between each cutter and the bar. Means is provided for braking rotation of the cutters after each occurrence of the row of cutters contacting the surface of a solid substrate during rotation of the cutter cage. The braking means permits the cutters to rotate during contact with the solid substrate and brake cutter rotation thereafter.

The brake means comprises means for each bar for providing frictional engagement amongst the cutters of the row and frictional engagement between end portions of the row of cutters and adjacent the plate portions. The means for providing the frictional engagement is a compressible resilient material. The cutters overcome the frictional engagement between the end portions of the row and the plate portions while in contact with the a substrate being treated whereby the cutters rotate while in contact with the solid substate.

BRIEF DESCRIPTION OF THE DRAWINGS

Preferred embodiments of the invention are shown in the drawings wherein:

FIG. 5 is a side plan view of the apparatus of FIG. 1 with a section removed to show the action of the cutters on the rotary cutter cage;

FIG. 6 is a section through the assembled rotary cutter cage demonstrating flexing in the cutter cage carrying bars; and FIG. 7 is a front plan view of the assembled rotary cutter cage further exemplifying flexing in the bars of the cutter cage during use.

DETAILED DESCRIPTION OF THE PREFERRED EMBODIMENTS

Figure 1:
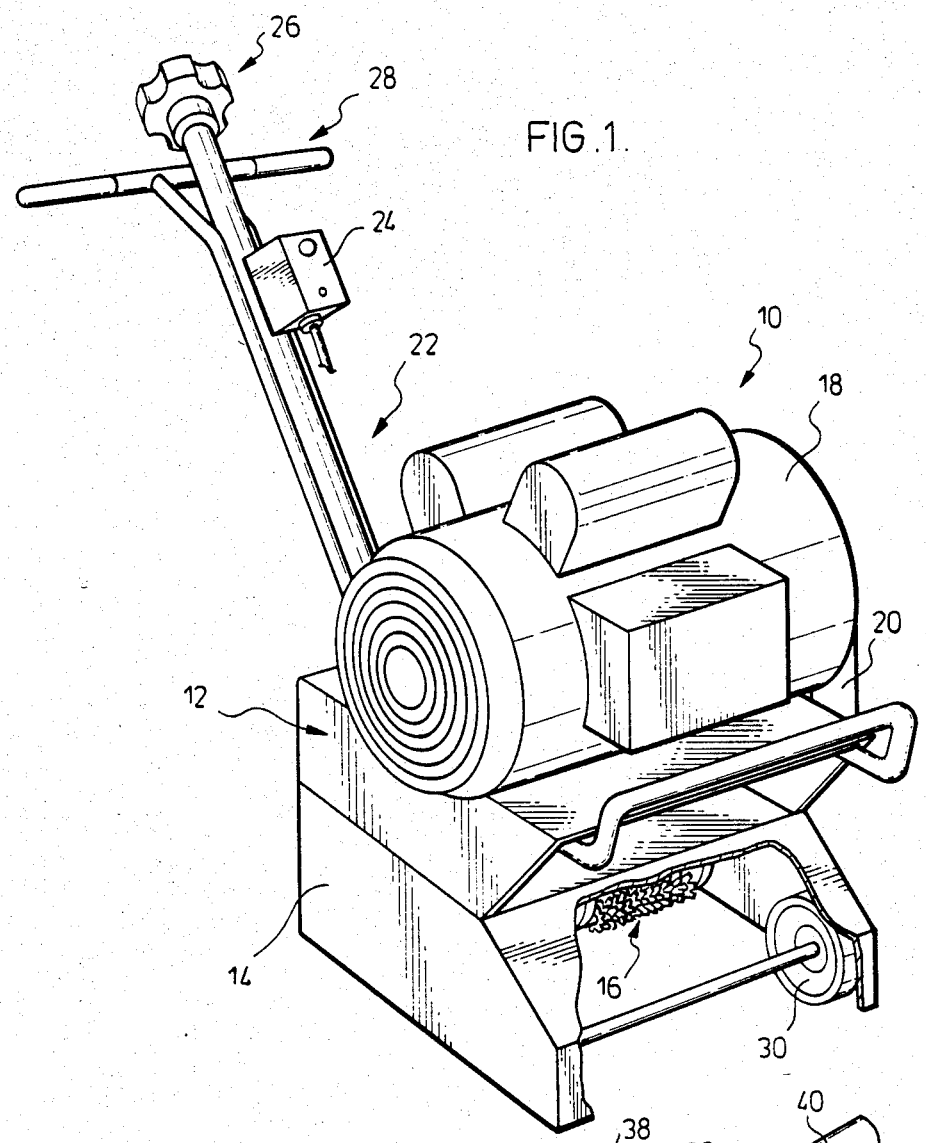
FIG. 1 is a perspective view of apparatus for removing material from a surface of a solid substrate.

The apparatus 10 of FIG. 1 has a support frame generally designated 12 with housing 14 for a rotary cutter cage 16 mounted within and on the frame. A motor 18 drives the rotary cutter cage through a belt drive housed within belt housing 20. A handle 22 with control switch 24 is mounted to the rear of support frame 12. A height adjustment knob 26 is provided conveniently at the upper portion 28 of the handle 22 to allow the operator to adjust the height of the rotary cutter cage relative to the surface to be treated. Not shown in FIG. 1 are hinged wheels at the rear of the support frame which operate in conjunction with the front wheels 30 mounted to the housing 14. This system allows the operator, by adjusting knob 26, to vary the height of the rotary cutter cage relative to the surface to be treated, and thereby vary the depth of the layer to be removed from the solid substrate.

Figure 2:
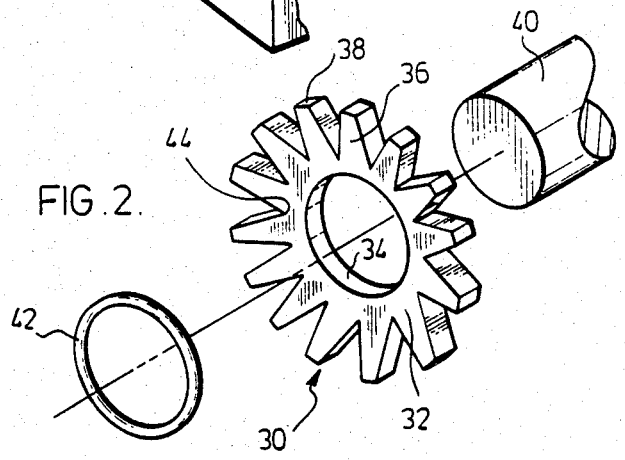
FIG. 2 is an exploded view of a cutter for mounting on a cutter cage bar.

A variety of cutter shapes may be used on the rotary cutter cage, such as, exemplified in the patents previously referred to. An example of a suitable cutter is shown in FIG. 2. The cutter element 30 has an essentially planar body portion 32 with a centrally located bore 34. Projecting outwardly of the body portion are a plurality of spikes 36 having at their tips hardened cutter teeth 38. Preferably the cutter element is formed from a hardenable metal, such as steel. The cutter element may be die cut from a plate of steel and subsequently case hardened to form the cutter teeth 38. The bore 34 is slightly larger than the diameter of the cylindrical bar 40 on which the cutter elements are mounted. Optionally O-ring spacers 42 may be provided between adjacent cutter elements 30. The O-ring spacers 42 may be either loose fitting or tight fitting on the bar 40 and have an external diameter less than the root portion 44 of the spikes of each cutter element.

Figure 3:
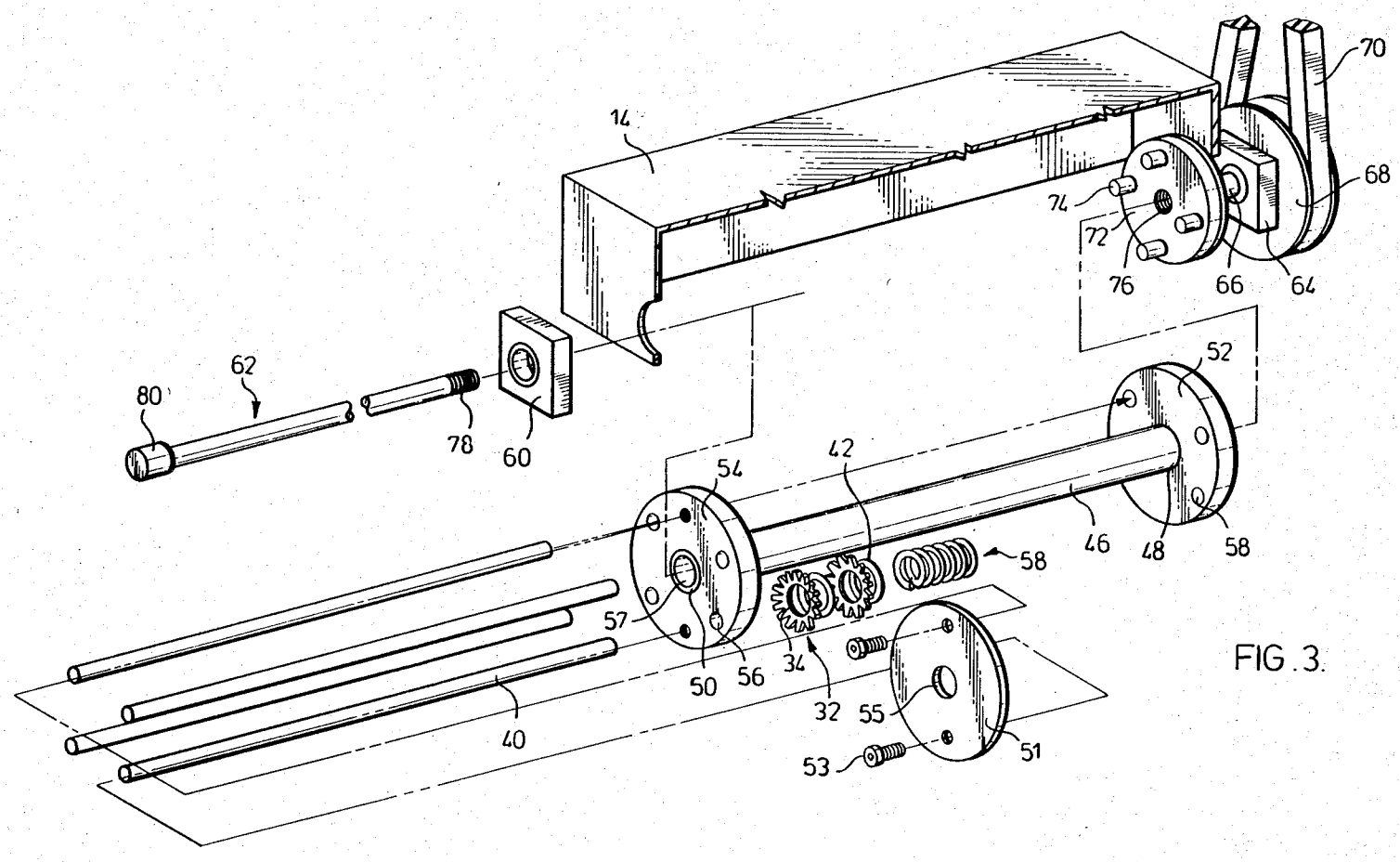
FIG. 3 is an exploded view of the rotary cutter cage to be assembled on the frame of the apparatus of FIG. 1.

A plurality of cutter elements are mounted on each individual bar 40 to form a respective row of a series of like cutter elements with or without spacers 42 therebetween. As shown in FIG. 3, the cutter cage assembly comprises a central axle 46 which has secured to its end portions 48 and 50 cylindrical plates 52 and 54. According to this embodiment of the invention, the bars 40, as mounted in the plates 52 and 54, may or may not have support intermediate the end plates as provided by other cylindrical plate portions or segments thereof. It is appreciated that for extended lengths of cutter cages, the intermediate supports may be necessary. This can result in a plurality of spaced-apart plate portions along the length of the cutter cage. According to the embodiment illustrated, the end plate 54 includes a plurality of apertures 56 which extend entirely therethrough. Plate 52 has a corresponding plurality of apertures 58 which form blind holes in the plate 52.

To assemble the cutter cage, the bars 40 are inserted through the respective aperture 56 and the cutter elements 32 are mounted on the bar by passing the bar through the respective aperture 34 of each cutter. The spacers 42 may optionally be provided between the cutter elements. In order to provide the desired braking action on rotation of the cutter elements relative to the bar 40, a brake device is also mounted on the bar portion 40. In accordance with this embodiment of the invention, a coil spring 58, as mounted on the bar 40, constitutes a part of the brake device. The coil spring may be provided on either or both ends of the set of cutter elements to be discussed with respect to FIG. 4.

After all of the bars 40 are positioned in the end plates 52 and 54 with the rows of cutters mounted thereon, they are secured in place by an end cap 51 which is secured to the outside of plate 54 by Allen screws 53. The aperture 55 of the end cap 51 is concentric with the aperture 57 of the hollow axle 46.

Upon assembly, according to aspect of the invention, of four rows of cutter elements on the rotary cutter cage, the cutter cage is mounted on the housing 14 of the apparatus. A bearing block 60 is secured to the housing 14 through which the cutter cage securing rod 62 extends. At the other end of the housing, a bearing block 64 is secured to the housing. Extending through the bearing block is a shaft 66 to which drive pulley 68 is keyed. The pulley is in turn driven by drive belt 70. Also secured to the drive shaft 66 is a drive hub 72. The drive hub has four drive pins 74 projecting therefrom and symmetrically spaced about the threaded bore 76. The outer side of plate 52 includes four apertures for receiving the drive pins 74 when the cutter cage assembly is mounted to the drive hub. The rotary cutter cage assembly bar 62 is passed through the bearing block 60 through the hollow axle 46 and threaded into bore 76. The enlarged head portion 80 of the connector rod 62 extends into the bearing block 60 to complete the assembly in the manner to be discussed with respect to FIG. 4.

The connector bar 62 extends through the hollow axle 46 and as threaded in bore 76, secures the cutter cage assembly generally designated 82 within the frame assembly of the apparatus. A spacer washer 84 is placed between the end cap 51 and the enlarged head portion 80 of the connector rod. The enlarged head portion includes internally a recess 86 which may be tightened with a wrench to secure the threaded end portion 78 in bore 76. The direction of threading in the bore 76 is such to cause a tightening of the connector rod 62 during rotation in the use direction of the rotary cage. The enlarged head 80 of the connector rod is bearingly supported by bearing 60. As a result, this arrangement provides for a very quick technique in replacing cutter cages. A variety of cutter cages may be used with a single apparatus frame depending upon the characteristics of the surface to be treated.

With the cutter cage arrangements of the prior patents, the cutter elements are free to rotate continuously relative to the carrier bars. This continued rotation of the cutters detracts from the effectiveness the cutters have on removal of surface material. This is particularly the case for elastomeric materials which are difficult to remove. It has been found that, by providing a means for braking rotation of the cutters, a significant improvement in coating removal is obtained. The means for braking rotation of the cutter element may, in one manner or another, be associated with the cutter cage to achieve the braking action. For example, the brake device may be associated with the bars for carrying the cutters. The brake device may include a compressible resilient material which is adapted to exert a compressible force on a set of cutter elements and brake rotation of the row of cutters after it has impacted a surface being treated.

According to this preferred embodiment of the invention, the cutter cage assembly 82 includes four rows of a plurality of cutter elements. Each row is generally designated 88. The mounting bar 40 is carried by the end plates 52 and 54. Each row of cutters consists of individual cutter elements 32 which, in this embodiment, are separated by O-ring spacers 42 to form a pack of cutter elements. A coil spring 58 is provided at each end portion 90 and 92 as generally designated for row 88. The coil springs 58 at each end of the row of cutter elements compress the plurality of cutter elements and spacers to develop frictional engagement between the body portions 32 of each cutter element and the body portion of each spacer ring 42. By way of compressing the coil springs 58 between the plate portions 52 and 54, which in this embodiment happen to be the end plate portions for the cutter cage, a degree of frictional engagement is established not only between individual cutter elements and the spacers, but also between the end portions 90 and 92 of the row of cutter elements and the respective end plates 52 and 54 which are fixed relative to the axle 46 of the cutter cage.

Figure 4:
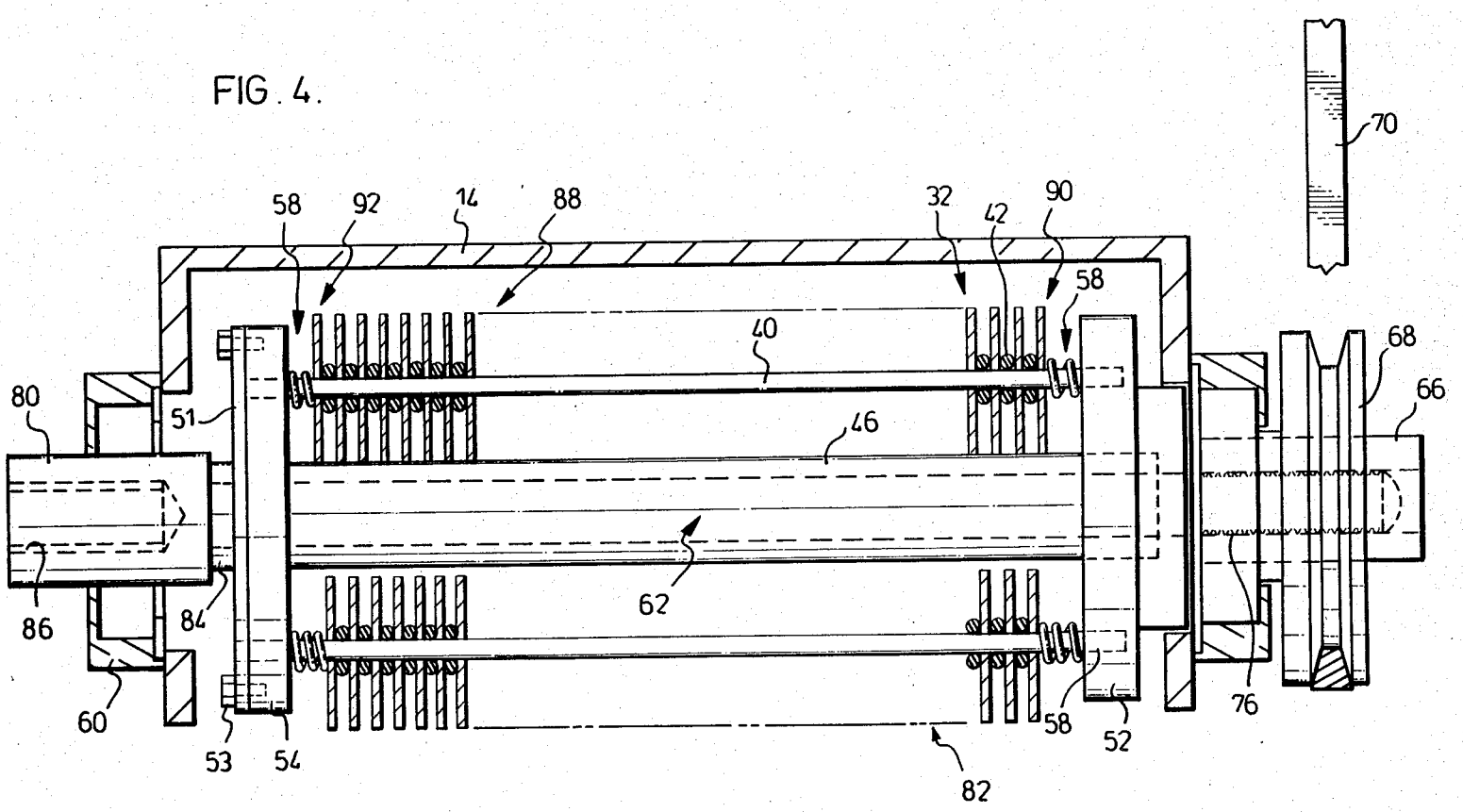
FIG. 4 is a front plan view of the assembled rotary cutter cage mounted on the frame of the apparatus of FIG. 1.

The purpose of the coil springs 58 is to brake rotation of the elements which is induced in the cutter elements while they are in contact with the surface being treated. The braking devices slow down significantly or stop rotation in the cutter elements before that row of cutter elements revolves around to again strike or impact the surface being treated. It is appreciated that in the embodiment using coil springs as the brake device, a single coil spring may be used at one end of the row of cutter elements or at both ends as shown in FIG. 4. Should support devices be used intermediate the length of the bars 40, additional brake elements in the form of coil springs may be used at those support portions.

With reference to FIG. 5, the apparatus 10 of FIG. 1 is travelling over a solid substrate 94 where surface 96 is being removed or treated. The surface 96 may be a coat of paint, sealing compound or a surface layer of the concrete substrate 94. The adjustment knob 26 may be used to raise and lower rear wheel 98 relative to the apparatus housing 14 to thereby adjust the height of the cutter cage 16 relative to the surface of the solid substrate. By adjusting the knob 26, a swing arm 100 is moved up and down relative to the frame 14 to provide the desired height of adjustment. During use, the rotary cutter cage 16 rotates in the direction of arrow 102 as driven by motor 18. As shown in FIG. 5, the bore portion 34 of each cutter element 30 is larger than the corresponding mounting bar 40. Due to centrifugal forces, the cutter elements 30 move outwardly to their outermost positions, as permitted by the size of the cutter bore. As the individual cutter elements 30 contact the surface 96 to be chipped or treated, the cutter element, for example **30*a*, is rotated in the direction of arrow 102. If the cutter elements were free to continue to rotate as noted in the prior patents, then the individual cutter elements particularly at high speeds of rotation of the cutter cage would still be rotating relative to the bar by the time the row of cutter elements had made one complete revolution to come into contact again with the surface 96. However, the braking device which permits a controlled or restricted rotation of the cutter elements 30*a* while in contact with the surface being treated, brakes rotation of the cutters before the respective row of cutter elements completes one revolution to again contact the solid substrate. The frictional engagement established between the cutter elements and spacers is determined by setting the brake device to permit at least rotation of the cutter elements while in contact with the substrate 94. However, the degree of frictional engagement is such between the end portions 90 and 92** of the row of cutter elements and the end plates of the rotary cutter cage that the speed of rotation induced in the cutter elements by the contacting substrate is either significantly reduced or stopped before that row of cutter elements completes one revolution.

Instead of the coil springs functioning as the compressible resilient brake material, it is appreciated that blocks, washers or spacers of elastomeric material may be used. A washer of an elastomeric material, such as, a urethane may be substituted for the coil spring. The elastomeric washer would have a thickness approximating the length of the coil spring. An elastomeric washer could be used at either or both ends of the respective row of cutters. Furthermore, the elastomeric material may be used as the spacer elements between the cutters. By judicious selection of the number of cutters and spacers, the desired compression in the row of cutters and elastomeric spacers and the plate portions can be achieved to provide the necessary degree of frictional engagement amongst the cutters and spacers, and between the end portions of the row of cutters and the cutter cage plate portions. In this manner, the desired braking action on the cutters can be achieved. It should also be appreciated that the compressible resilient material, whether it be the coil spring or the elastomeric material may be positioned at spaced intervals along the row of cutters between adjacent cutters, such that when compressed between the plate portions, the desired braking action is achieved. During use of the cutters, it is possible that, due to wear, the cutters may become thinner resulting in a reduction in overall strength of said row of cutters. The compressed resilient material of the brake device, such as the coiled springs, is sufficiently compressed to accommodate reduction in overall length of the cutter row and maintain the desired degree of braking action.

It is also appreciated that the braking device can be associated with portions of the cutter cage other than with the cutter bars. One of the plate portions 52 or 54 could be adapted to slide along the axle 46 and the bars 40. For example, an elastomeric washer or coil spring could be mounted exterior of plate 54 in a manner to force plate 54 towards plate 52. The external brake device on the plate 54 would serve to compress the rows of cutters and develop the desired degree of frictional engagement between the cutters and the plate portions.

It has been discovered that superior results are now achieved by use of a device for braking rotation of the cutter elements. Although the action of the braking device is not fully understood due to the high circumferential speeds of the cage in the range of approximately 1,800 feet/minute to 3,000 feet/minute, it is theorized that the braking device is essentially stopping or considerably slowing rotation of the cutters relative to the bar before the next impact to impart thereby the maximum force developed by rotation of the cutter cage. Whereas if the cutters are free to rotate at all times, and due to their rotating in a direction corresponding with the direction of travel of the apparatus, the impact force by the cutter elements is reduced. It has also been discovered that the brake device, in limiting or restricting rotation of the cutter as they move over the surface, is exceptionally useful for removing elastomeric coatings. The engagement of the cutters with the surface results in sufficient force to overcome the action of the brake. However, this results in the cutters being dragged over the surface thereby causing an extended cutting or scraping action across the surface. The cutting action, as noted, is particularly useful in removing resilient elastomeric coatings on concrete and the like.

It is appreciated that the carrier bars 40 may or may not be supported intermediate their end portions. By appropriate selection of high tensile strength metal for the bars 40, a flexing action can be accomplished in the bars as caused by centrifugal force exerted on the bars by the cutters as the cutter cage revolves at high speeds. As shown in FIG. 6, the carrier bars 40 flex outwardly to the extent indicated by 40*a* in FIG. 7, because of lack of support for the bars intermediate their length. This has resulted in surprisingly increased efficiency in impacting the surface 96 of the substrate 94 being treated. The flexing of the bars is thought to effect a hammer blow to the surface to increase the impact forces on the surface and thereby improve removal of material from the substrate surface. It is appreciated that the tensile strength of the metal used in fabricating the bars will determine the extent to which they flex intermediate their length and also their resistance to fracture and breakage during use.

The brake system, according to this invention for the plurality of cutters on the cutter head, permits limited rotation of the individual cutter elements while in contact with the surface being treated and subsequently brakes rotation of the individual cutter elements. The limited rotation of the cutter elements, as permitted by the brake means, thereby ensures that even wear is imparted to the cutter teeth of the cutter elements. It is appreciated that the brake system can be used with a variety of cutter elements other than the star-shaped elements discussed with respect to FIG. 2. In essence any rotary cutter cage for use in surface preparation having elements, which rotate when in contact with a surface being treated, may be used in association with the braking system according to this invention. Thus the brake system can be used with any rotary cutter design and, according to a preferred embodiment of the invention, the braking system relies on frictional braking of the cutter element rotation by frictionally engaging the end portions of the stacks or rows of cutter elements with the plate portions of the cutter cage which in themselves stationary relative to the axle of the cutter cage.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. In an apparatus for removing surface material from a solid substrate comprising a support frame, a rotary cutter cage, means for mounting said rotary cutter cage on said support frame, means for rotating said rotary cutter cage, said rotary cutter cage having at least two spaced-apart plate portions to which at least one bar is connected, a plurality of cutters being mounted along each of said at least one bar to provide at least one row of said plurality of cutters, said cutters impacting a solid substrate during rotation of said cutter cage, each of said cutters having a bore through which said bar extends in mounting said plurality of cutters on said cutter cage, said bore being larger than said bar to permit rotation of each said cutter on said bar at least during contact with a surface being treated, said cutter cage having means for braking rotation of said cutter after each occurrence of a corresponding said row of said cutters contacting a surface being treated during rotation of said cutter cage, said brake means being provided for each of said at least one bar for frictionally engaging adjacent cutters and frictionally engaging end portions of said row of cutters with said respective plate portions, said brake means establishing a degree of frictional engagement between said cutters and said plate portions to permit said cutters to rotate during contact with a surface being treated and brake rotation of said cutters before said row of cutters contact such surface again said brake means comprising a compressible resilient material associated with each said row of cutters, the extent to which said material is compressed determining said degree of frictional engagement.

2. In an apparatus of claim 1, said compressible resilient material comprises a coil spring mounted on said bar at least at one said end portion of said row of cutters and compressed between said respective end portion and said plate portion proximate said corresponding end portion of said cutters, the degree of compression in said spring determining said degree of frictional engagement to ensure a braking of rotation of said cutters after contacting such surface being treated.

3. In an apparatus of claim 2, said coil spring is provided at both end portions of said row of cutters, the extent of compression of said springs between the end portions of said row of cutters and said plate portions determining said degree of frictional engagement.

4. In an apparatus of claim 2, said plurality of cutters being separated on said bar by individual spacers, each spacer being provided between adjacent cutters mounted on said bar.

5. In an apparatus of claim 3, said plurality of cutters being separated on said bar by individual spacers, each spacer being provided between adjacent cutters mounted on said bar.

6. In an apparatus of claim 5, said brake means in combination with a number of cutters and spacers in said row for a given distance between said plate portions provides said degree of compression in said coil springs.

7. In an apparatus of claim 1, said compressible resilient material is an elastomeric washer, said elastomeric washer being provided between at least one end portion of said row of cutters and a corresponding said plate portion, the extent of compression of said elastomeric washer determining said degree of frictional engagement.

8. In an apparatus of claim 7, said elastomeric washer is provided at both end portions of said row of cutters, the extent of compression of said elastomeric washers between the end portions of said row of cutters and said plate portions determining said degree of frictional engagement.

9. In an apparatus of claim 1, wherein said compressible resilient material is a plurality of individual elastomeric spacers, the spacers are provided between adjacent cutters mounted on said bar, said row of cutters with said plurality of elastomeric spacers therebetween being compressed between said plate portions, the extent of compression of said spacers determining said degree of frictional engagement.

10. A rotary cutter cage for use with an apparatus for removing material from the surface of a solid substrate, said cutter cage comprising an axle with at least two opposing plate portions mounted on said axle, said plate portions having means for carrying at least one bar extending between said plate portions, said at least one bar being radially spaced from and parallel to said axle, said bar having a row of a plurality of cutters mounted thereon by each said cutter having a bore through which said bar extends, said bore being larger than said bar to permit relative rotation between each cutter and said bar, means for braking rotation of said cutters after each occurrence of said row of cutters contacting the surface of a solid substrate during rotation of said cutter cage, said braking means permitting said cutters to rotate during contact with a solid substrate and braking cutter rotation thereafter, said brake means comprising means for each said bar for providing frictional engagement amongst said cutters of said row and frictional engagement between end portions of said row of cutters and adjacent said plate portions, said means for providing said frictional engagement is a compressible resilient material, said cutters overcoming said frictional engagement between said end portions of said row and said plate portions while in contact with a substrate being treated whereby said cutters rotate while in contact with a solid substrate.

11. A rotary cutter cage of claim 10, wherein said compressible resilient material is of elastomeric material.

12. A rotary cutter cage of claim 10, wherein said means for providing frictional engagement comprises a coil spring through which said bar extends.

13. A rotary cutter cage of claim 12, wherein a coil spring is compressed between each said end portion of said row of cutters and an adjacent said plate portion to provide said frictional engagement.

14. A rotary cutter cage of claim 13, wherein said plate portions are cylindrical end plates for said cutter cage, said bar extending from one end plate to the other end plate unsupported.

15. A rotary cutter cage of claim 13, wherein four rows of said plurality of cutters are symmetrically spaced about said axle.

16. A rotary cutter cage of claim 15, wherein said coil spring provides essentially constant compressive forces on said plurality of cutters for a limited reduction in overall length of said row of cutters due to wear on said cutters.

17. A rotary cutter cage of claim 16, wherein each cutter is essentially planar and is star-shaped.

18. A rotary cutter cage of claim 10, wherein a spacer is provided between adjacent cutters.

* * * * *